US011209203B2

(12) United States Patent
Saito et al.

(10) Patent No.: US 11,209,203 B2
(45) Date of Patent: Dec. 28, 2021

(54) ICE MAKING DEVICE

(71) Applicant: NIDEC SANKYO CORPORATION, Nagano (JP)

(72) Inventors: Shunji Saito, Nagano (JP); Akihiro Ito, Nagano (JP); Takaji Harata, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 51 days.

(21) Appl. No.: 16/808,384

(22) Filed: Mar. 4, 2020

(65) Prior Publication Data

US 2020/0284492 A1 Sep. 10, 2020

(30) Foreign Application Priority Data

Mar. 6, 2019 (JP) ..... JP2019-040442

(51) Int. Cl.
*F25D 17/06* (2006.01)
*F25C 1/10* (2006.01)
*F25C 1/12* (2006.01)

(52) U.S. Cl.
CPC ..... *F25D 17/06* (2013.01); *F25C 1/12* (2013.01); *F25C 2301/00* (2013.01); *F25D 2317/0681* (2013.01); *F25D 2331/812* (2013.01)

(58) Field of Classification Search
CPC .... F25C 1/12; F25C 2301/00; F25C 2400/10; F25D 2317/061; F25D 17/06; F25D 2317/0681; F25D 2331/812
See application file for complete search history.

(56) References Cited

U.S. PATENT DOCUMENTS 6,438,988 B1 * 8/2002 Paskey ..... F25C 1/04 62/353
7,739,884 B2 6/2010 Jeong et al.
2007/0170788 A1 7/2007 Werner
2013/0291582 A1 * 11/2013 Cox ..... F25C 1/24 62/340
2014/0130537 A1 * 5/2014 Gu ..... F25C 5/22 62/344

FOREIGN PATENT DOCUMENTS

CN 1590932 3/2005
CN 1755277 4/2006
CN 1886881 12/2006
(Continued)

OTHER PUBLICATIONS

English Language Translation of DE 102011006671 translated Jun. 18, 2021 (Year: 2012).*
(Continued)

*Primary Examiner* — Cassey D Bauer
(74) *Attorney, Agent, or Firm* — JCIPRNET

(57) ABSTRACT

To provide an ice making device including an ice making tray, a drive unit configured to turn over the ice making tray, a frame including a frame body, the frame configured to support the ice making tray, and a fan motor configured to send wind to the ice making tray. The frame includes a block unit configured to contact a part of the ice making tray turning over to partially disturb the turning over of the ice making tray, and the fan motor is fixed only to a first frame part including one of a plurality of frame parts constituting sides surrounding a periphery of the ice making tray in a plan view of the frame.

8 Claims, 6 Drawing Sheets

(56) References Cited

FOREIGN PATENT DOCUMENTS

| | | | |
|---|---|---|---|
| CN | 1982812 | 6/2007 | |
| CN | 102706067 | 10/2012 | |
| DE | 10 2011006671 | * 10/2012 | ..... F25C 1/04 |
| JP | H10160307 | 6/1998 | |
| JP | 2002048438 | 2/2002 | |
| JP | 4211025 | 1/2009 | |
| JP | 2017161086 | 9/2017 | |

OTHER PUBLICATIONS

Office Action of China Counterpart Application, with English translation thereof, dated Jun. 3, 2021, pp. 1-13.

* cited by examiner

ICE MAKING DEVICE

CROSS-REFERENCE TO RELATED APPLICATION

This application claims the priority benefit of Japan Application No. 2019-040442, filed on Mar. 6, 2019. The entirety of the above-mentioned patent application is hereby incorporated by reference herein and made a part of this specification.

BACKGROUND

Field of the Invention

At least an embodiment of the present invention relates to an automatic ice making technology, and particularly, to an ice making device equipped with a cooling fan.

Description of the Related Documents

Japanese Unexamined Patent Application Publication No. 2017-161086 (hereinafter, referred to as Patent Document 1) discloses an ice making device provided with a fan motor configured to send wind to an ice making tray. In the ice making device of Patent Document 1, an upper surface of a frame configured to support the ice making tray has an opening in a frame shape, and the fan motor is laid across the opening, and is fixed to the upper surface of the frame.

The ice making device of Patent Document 1 includes a drive unit configured to rotate the ice making tray, and the drive unit is equipped with a control unit of the fan motor. The control unit of the fan motor starts the drive of the fan motor upon receiving a signal indicating completion of water supply to the ice making tray, and stops the fan motor if a temperature of the ice making tray reaches a predetermined temperature.

Patent Literature 1

Japanese Unexamined Patent Application Publication No. 2017-161086

In an ice making device in which a part of an ice making tray is brought into contact with a frame and the ice making tray is twisted to take out ice, the frame may be temporarily distorted by the force applied to the frame when the ice making tray is twisted. If a fan motor is fixed to such a frame, a fixing unit of the fan motor may be loosened or damaged due to distortion of the frame.

In view of such problems, an object of at least an embodiment of the present invention is to provide an ice making device, particularly, a so-called twist-type ice making device capable of reducing an influence on a fan motor caused by distortion of a frame during removing ice.

SUMMARY

To solve the above-described problems, at least an embodiment of the present invention provides an ice making device including an ice making tray, a drive unit configured to turn over the ice making tray, a frame being a frame body, the frame configured to support the ice making tray, and a fan motor configured to send wind to the ice making tray. The frame includes a block unit configured to contact a part of the ice making tray turning over to partially disturb the turning over of the ice making tray, and the fan motor is fixed only to a first frame part being one of a plurality of frame parts constituting sides surrounding a periphery of the ice making tray in a plan view of the frame.

When a part of the ice making tray is pressed against the block unit of the frame, the frame being a frame body is deformed so that its outer shape is twisted. At this time, if the fan motor is fixed to a plurality of frame parts constituting the frame, the displacement directions and displacement amounts of these frame parts differ from each other, and thus, a fixing surface of the fan motor is distorted. In the ice making device according to at least an embodiment of the present invention, the fan motor is fixed only to one frame part constituting the frame, and thus, distortion of the fixing surface of the fan motor is suppressed to a small degree, and loosening and damage of the fixing unit of the fan motor are suppressed.

Furthermore, in at least an embodiment of the present invention, it is preferable that the frame includes a mounting unit configured to fix the ice making device in a freezing room, and the mounting unit is provided on the first frame part. When the mounting unit is immovably fixed in the freezing room, deformation of the first frame part is limited by the mounting unit. Thus, the distortion of the fixing surface of the fan motor is further suppressed to a small degree.

At this time, it is preferable that the first frame part includes a plurality of the mounting units, and the fan motor is fixed between one of the mounting units and a different one of the mounting units included in the first frame part. In a portion between two mounting units in the first frame part, the propagation of distortion is mutually interrupted by these mounting units, and thus, the amount of deformation is particularly small. As a result, the distortion of the fixing surface of the fan motor can be further suppressed to a small degree.

Furthermore, in the ice making device according to at least an embodiment of the present invention, it is preferable that an outer peripheral shape of the frame is substantially rectangle in a plan view of the frame, and the first frame part constitutes one of long sides in the plan view of the frame. One of the long sides, which are easily deformed compared to short sides, is fixed with the mounting unit, and thus, the amount of deformation in the entire frame can be reduced.

Furthermore, in at least an embodiment of the present invention, it is preferable that the frame includes, of the frame parts, a second frame part being a frame part facing the first frame part across the ice making tray, and a rotation center of the fan motor is located at a position closer to a side of the first frame part than a center position between the first frame part and the second frame part in a plan view of the frame. For example, if the mounting unit of the first frame part is fixed to a wall surface of the freezing room, or if a wind path on a side of the first frame part is narrow due to the shape of the first frame part, the wind from the fan motor stagnates on the side of the first frame part and air pressure near the first frame part is higher than air pressure at a different location, and thus, the wind from the fan motor hardly flows to the side of the first frame part. Therefore, when the fan motor is placed beforehand at a position closer to the side of the first frame part and the wind path is set to flow the wind from the fan motor from the side of the first frame part to a different side, the air stagnation at the side of the first frame part can be prevented and solidification heat can be released smoothly.

At this time, it is preferable that the second frame part is a plate-shaped frame part, and the second frame part is provided with a notch through which the wind from the fan motor blows in a horizontal direction. Providing the notch on the second frame part can cause the wind from the fan motor to smoothly flow from the side of the first frame part to a side of the second frame part.

Furthermore, in at least an embodiment of the present invention, it is preferable that the first frame part includes a pedestal unit as a portion having a thickness in an up-down direction greater than a thickness of a different portion, and the fan motor is fixed to the pedestal unit. When the fixing surface of the fan motor is formed thick and rigidity thereof is enhanced, even if the first frame part deforms, the distortion of the fixing surface of the fan motor is suppressed to a small degree.

Furthermore, in the ice making device according to at least an embodiment of the present invention, it is preferable that the ice making tray is made of resin, and the fan motor sends wind to the ice making tray from above the ice making tray. Unlike an ice making tray made of metal, an ice making tray made of resin acts like a heat insulating material, and thus, if the wind from the fan motor blows from under the ice making tray, inefficiency of the fan motor occurs. If the wind from the fan motor blows from above the ice making tray, that is, the wind directly blows to the water, solidification heat can be smoothly released from the water in the ice making tray made of resin.

Furthermore, in at least an embodiment of the present invention, it is preferable that an outer peripheral shape of the fan motor is substantially square in a plan view of the fan motor, and the fan motor is fixed to the first frame part only at an end included in one side of the fan motor in the plan view of the fan motor.

As described above, the ice making device, particularly, a so-called twist-type ice making device, according to at least an embodiment of the present invention can reduce an influence on the fan motor caused by distortion of the frame during removing ice.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Embodiments of an ice making device according to at least an embodiment of the present invention will be described below with reference to the drawings. An ice making device U described below is a device for automatically making ice, being installed in a freezing room of a refrigerator-freezer (not illustrated) being a host device of the ice making device U.

In the following description, "up-down" means a direction parallel to a Z axis of the coordinate axis depicted in each of the drawings, and a Z1 side is defined as "up" and a Z2 side is defined as "down". "Front and rear" means a direction parallel to an X axis of the same coordinate axis, and an X1 side is defined as "front" and an X2 side is defined as "rear". Similarly, "left and right" means a direction parallel to a Y axis of the same coordinate axis, and a Y1 side is defined as "right" and a Y2 side is defined as "left". In addition, "horizontal" means an XY plane direction indicated by the same coordinate axis.

(Configuration Overview)

Figure 1:
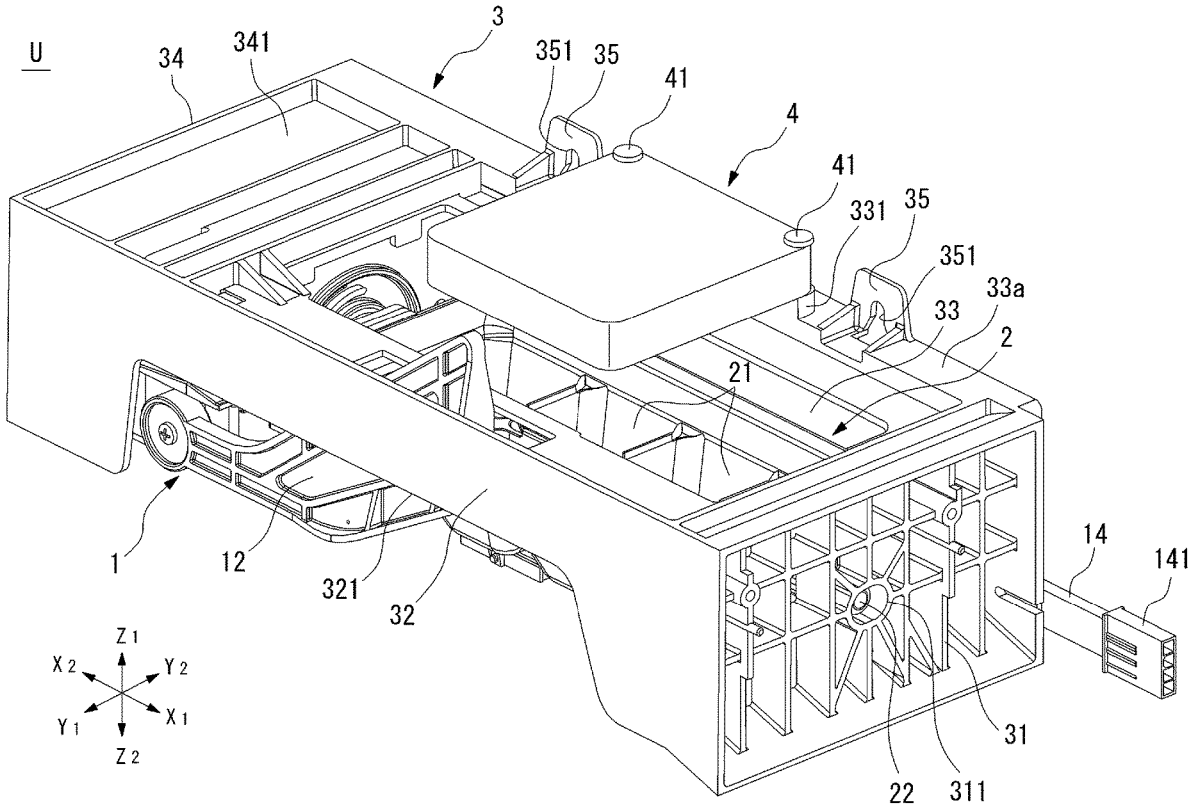
FIG. 1 is a perspective view illustrating an appearance of an ice making device according to an embodiment.
Figure 2:
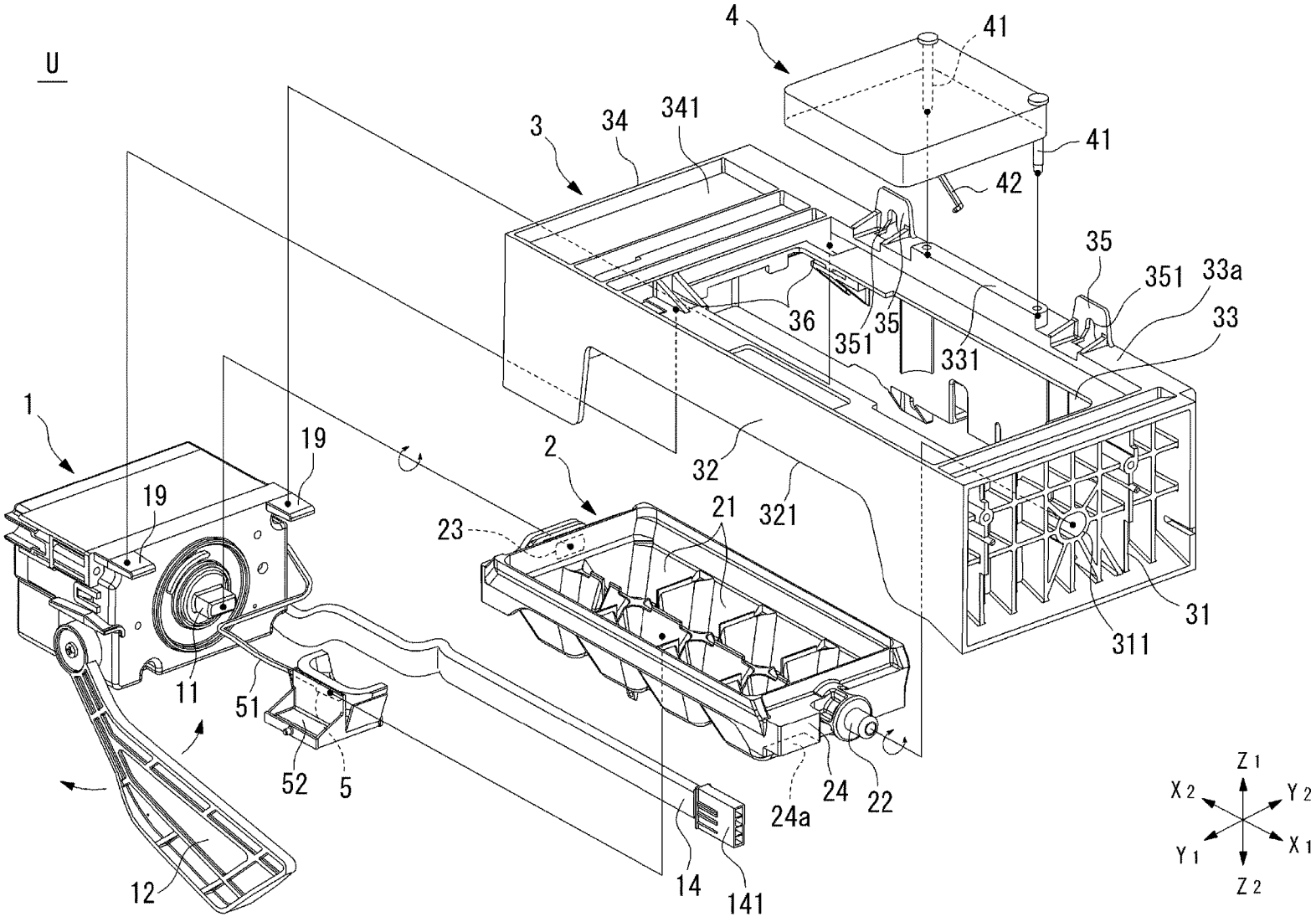
FIG. 2 is an exploded perspective view of the ice making device.

FIG. 1 is a perspective view illustrating an appearance of the ice making device U. FIG. 2 is an exploded perspective view of the ice making device U. The ice making device U mainly includes an ice making tray 2, a driving unit 1 configured to rotate the ice making tray 2, a frame 3 configured to support the ice making tray 2 and the driving unit 1, and a fan motor 4 fixed to an upper surface of the frame 3.

The ice making device U is a so-called "twist-type" ice making device. In a freezing room where the ice making device U is installed, an ice storage container (not illustrated) is arranged below the ice making device U. The ice making device U twists the ice making tray 2 to take out ice from the ice making tray 2, and drops the ice into the ice storage container. In the following description, an operation of taking out ice from the ice making tray 2 is referred to as "ice removing operation", and a mechanism of taking out ice from the ice making tray 2 is referred to as "ice removing mechanism". As will be described in detail below, an ice removing mechanism according to the present embodiment includes the driving unit 1 being a drive unit, a convex unit 24 of the ice making tray 2, and a block unit 312*a* (see FIG. 5) provided on the frame 3.

Figure 3:
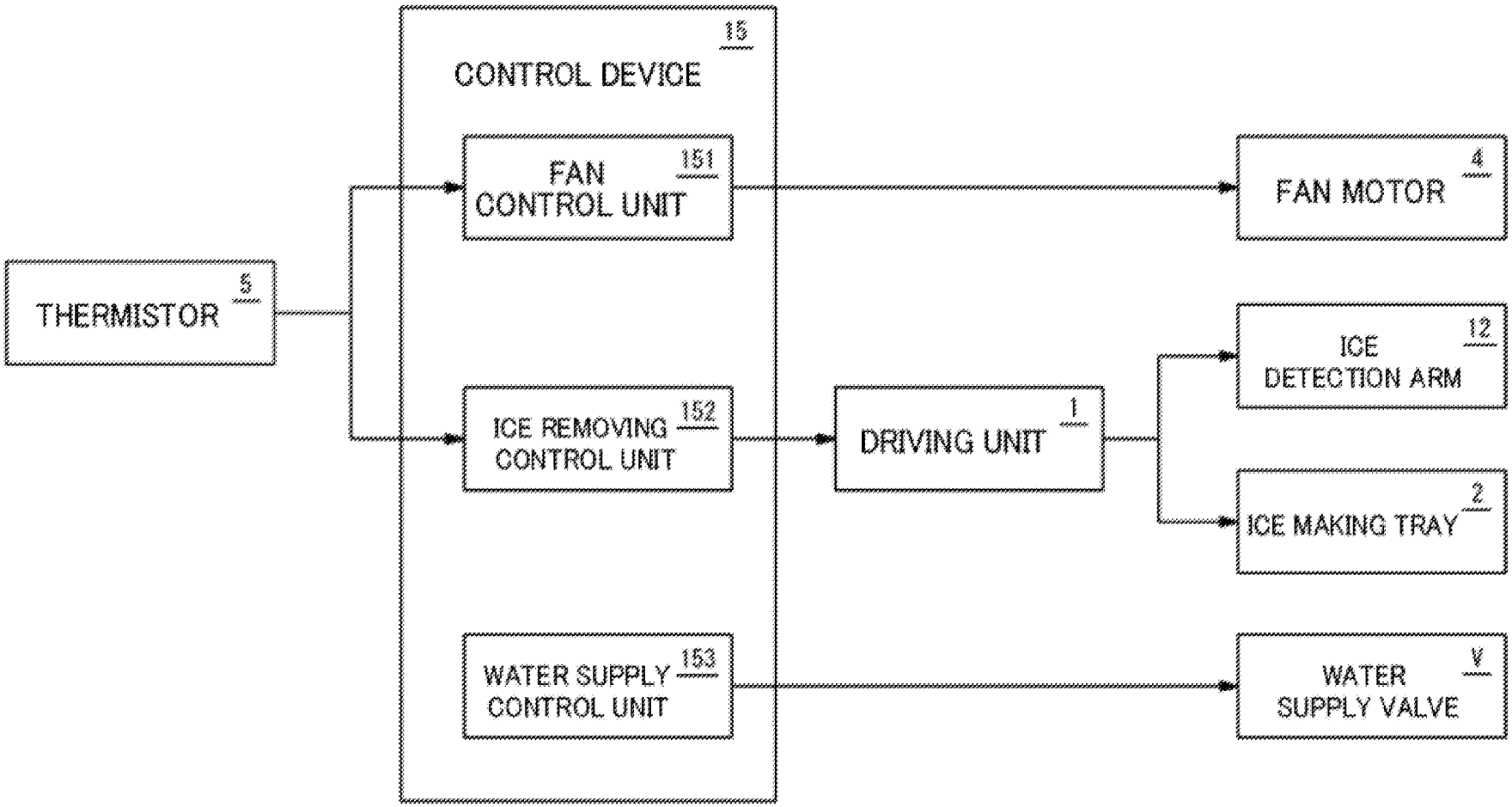
FIG. 3 is a block diagram illustrating a functional configuration of a control device serving as a control unit of the ice making device.

FIG. 3 is a block diagram illustrating a functional configuration of a control device 15 serving as a control unit of the ice making device U. The control device 15 according to the present embodiment is placed in a case of the driving unit 1. The control device 15 controls operations of the driving unit 1 and the fan motor 4 and an operation of a water supply valve V being a water supply mechanism configured to open and close a water supply path for supplying water to the ice making tray 2. This allows the ice making device U to execute a series of operations from supplying water to removing ice, independently from the host device.

(Driving Unit)

The driving unit 1 will be described below with reference to FIG. 2. The driving unit 1 is a motor unit including a motor serving as a drive source. A power feeding cable 14 extends from a side surface on a left side (Y2 side) of the driving unit 1, and a connector 141 of the power feeding cable 14 is coupled to a power line wired in the freezing room.

On a front surface of the driving unit 1, an output shaft 11 being a shaft body fitted to a rear surface of the ice making tray 2 is provided to protrude forward. The driving unit 1 turns over a top and a bottom of the ice making tray 2.

An ice detection arm 12 being an arm member configured to inspect the amount of ice in the ice storage container is attached to a side surface on a right side (Y1 side) of the driving unit 1. The ice detection arm 12 is a plate-shaped member having a substantially fan shape in a side view gradually spreading up and down from a base end toward a front end of the ice detection arm 12. The base end of the ice detection arm 12 is coupled to the driving unit 1, and the driving unit 1 tunes the ice detection arm 12 up and down around the base end of the ice detection arm 12. When the ice removing operation starts, the driving unit 1 lowers the ice detection arm 12 into the ice storage container before taking out ice from the ice making tray 2 to inspect the amount of ice in the ice storage container, confirms that there is still a space in the ice storage container, and then rotates the ice making tray 2.

A fitting piece 19 being a convex unit having a flat plat shape protrudes forward from both left and right ends of the upper surface of the driving unit 1. The frame 3 is provided with a fitting slot 36 being a concave unit corresponding to the shape of the fitting piece 19. The driving unit 1 is fixed to a rear end portion of the frame 3 when the fitting piece 19 is inserted into the fitting slot 36 of the frame 3.

Furthermore, as described above, the control device 15 according to the present embodiment is arranged in the case of the driving unit 1. When the case of the driving unit 1 is used for protecting the control device 15, the structure of the ice making device U is simplified as compared with a configuration in which a case body accommodating the control device 15 is separately prepared.

(Ice Making Tray)

The ice making tray 2 will be described below with reference to FIG. 2. The ice making tray 2 according to the present embodiment is an elastically deformable water storage container made of resin.

A water storage part of the ice making tray 2 is divided into a plurality of cells 21. Each of the cells 21 is formed with a slit that allows spaces in the cells 21 adjacent to the front and rear or to the left and right to communicate with each other, and thus, water supplied to some of the cells 21 is evenly distributed to all of the cells 21 through the slit.

A shaft hole 23 having the same shape as the output shaft 11 of the driving unit 1 is formed on the rear surface of the ice making tray 2. When the output shaft 11 is fitted into the shaft hole 23, the ice making tray 2 rotates in conjunction with the rotation of the output shaft 11. A shaft unit 22 being a shaft body protruding forward is provided on a front surface of the ice making tray 2, and the shaft unit 22 is rotatably supported by a bearing unit 311 formed on the frame 3.

Furthermore, the convex unit 24 protruding forward from the cells 21 is provided at a front end on a right half side (Y1 side) of the ice making tray 2. The convex unit 24 is a part of the ice removing mechanism according to the present embodiment.

Furthermore, a thermistor 5 being a temperature sensor configured to acquire a temperature of the ice making tray 2 is arranged on a bottom surface of the ice making tray 2. The thermistor 5 is attached to the bottom surface of the ice making tray 2 by a sensor cover 52, and a lead wire 51 of the thermistor 5 is coupled to the control device 15 in the driving unit 1.

(Control Unit)

As illustrated in FIG. 3, the control device 15 according to the present embodiment includes a fan control unit 151 configured to control the drive of the fan motor 4, an ice removing control unit 152 configured to control the drive of the ice detection arm 12 and the ice making tray 2 (the output shaft 11 of the driving unit 1) via the driving unit 1, and a water supply control unit 153 configured to open and close the water supply valve V.

The control device 15 includes the ice removing control unit 152 and the water supply control unit 153, and thus, is configured to autonomously perform a series of operations from supplying water to the ice making tray 2 to removing ice. Furthermore, the ice removing control unit 152 executes the ice removing operation based on a detection value of the thermistor 5. This makes it possible to made high-quality ice stably and more efficiently as compared with a case where a series of ice making operations is performed, based on time, for example. In addition, the control device 15 according to the present embodiment includes the fan control unit 151, and is configured to finely adjust the start/stop of the fan motor 4 based on a detection value of the thermistor 5.

It is noted that a hardware configuration of the control device 15 is not particularly limited as long as the above-described functions can be achieved. For example, one or a plurality of circuit boards, field-programmable gate arrays (FPGAs), complex programmable logic devices (CPLDs), microcontrollers or the like can be employed for the control device 15.

(Frame)

Figure 4:
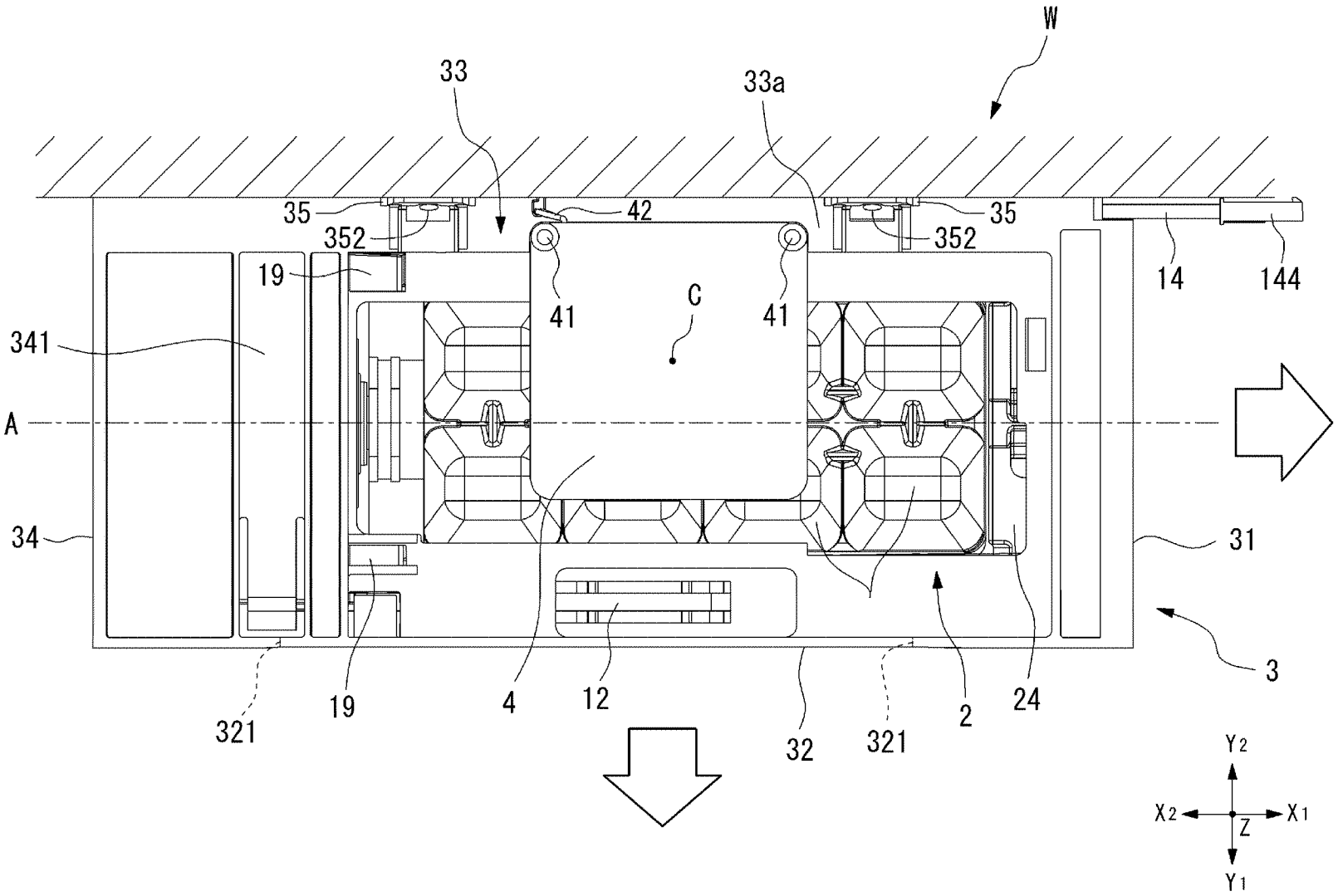
FIG. 4 is a plan view of the ice making device.

FIG. 4 is a plan view of the ice making device U. The structure of the frame 3 according to the present embodiment will be described below with reference to FIGS. 1, 2, and 4.

The frame 3 is a frame body made of resin configured to support the driving unit 1 and the control device 15 built in the driving unit 1, the ice making tray 2, and the fan motor 4. The frame 3 according to the present embodiment includes a front plate unit 31, a right plate unit 32 (second frame part), a left plate unit 33 (first frame part), and a rear plate unit 34, which are plate-shaped frame parts surrounding four directions of the ice making tray 2, and the sides of these frame parts are arranged so that the frame 3 has a substantially rectangular shape in a plan view.

The front plate unit 31 is a frame part constituting a front surface of the frame 3. The front plate unit 31 is a wall unit hollowed in a lattice shape, and is formed to be thicker than the other frame parts. A bearing unit 311 configured to support the shaft unit 22 of the ice making tray 2 is formed at the center in a front view of the front plate unit 31. As will be described in detail below, a block unit 312*a* configured to contact the convex unit 24 of the ice making tray 2 during the ice removing operation to partially disturb the rotation of the ice making tray 2 is formed integrally on a back side of the front plate unit 31.

The right plate unit 32 is a frame part constituting a right surface of the frame 3. The right plate unit 32 is a thin flat plate unit, and constitutes one of the long sides in a plan view of the frame 3. A notch 321 is provided on a lower side of the right plate unit 32. The notch 321 is formed over a range in which almost the entire length of the ice making tray 2 is visible as the ice making device U is viewed in a Y2 direction, and the wind from the fan motor 4 blows out from the notch 321 in the horizontal direction.

The left plate unit 33 is a frame part constituting a left surface of the frame 3. The left plate unit 33 constitutes the other long side in a plan view of the frame 3. A horizontal surface (upper surface 33*a*) having an area larger than an area of the right plate unit 32 is provided at an upper end of the left plate unit 33, and the fan motor 4 is fixed to the upper surface 33*a*. Furthermore, two mounting units 35 configured to fix the ice making device U to a wall surface W of the freezing room with screws 352 are provided on the upper surface 33*a* of the left plate unit 33. The right plate unit 32 and the left plate unit 33 constituting the long sides in a plan view of the frame 3 are more easily deformed than the front plate unit 31 and the rear plate unit 34 constituting the short sides. In the present embodiment, the mounting units 35 of the left plate unit 33 constituting one of the long sides are fixed to the wall surface W of the freezing room, and thus, the amount of deformation in the entire frame 3 is suppressed to be a small degree. It is noted that an object to which the mounting units 35 are joined is not limited to the wall surface W of the freezing room, and may be, for example, a different part in the freezing room or a different member placed in the freezing room. A pedestal unit 331 is provided between the two mounting units 35 of the left plate unit 33, the pedestal unit 331 being a thick portion formed so that the height of the upper surface 33*a* is higher than a different portion, and the fan motor 4 is fixed to the pedestal unit 331 with a screw 41.

The rear plate unit 34 is a frame part constituting a rear surface of the frame 3. The rear plate unit 34 covers a rear surface of the driving unit 1, and a top plate unit 341 covering the upper surface of the driving unit 1 is provided at the rear end portion of the frame 3. The top plate unit 341 is continuously formed from an upper end of the rear plate unit 34 and from upper ends of the right plate unit 32 and the left plate unit 33 near the rear plate unit 34.

The frame 3 according to the present embodiment is a substantially rectangular-shaped frame body in a plan view including four plate-shaped frame parts, but the shape of the frame 3 may be, for example, a substantially triangular shape or a substantially polygonal shape more than a substantially pentagonal shape in a plan view. Furthermore, the frame part constituting each side surrounding the periphery of the ice making tray 2 is not limited to a linear shape in a plan view, and would also include a frame part formed in a circular arc shape.

(Ice Removing Operation)

Figure 5:
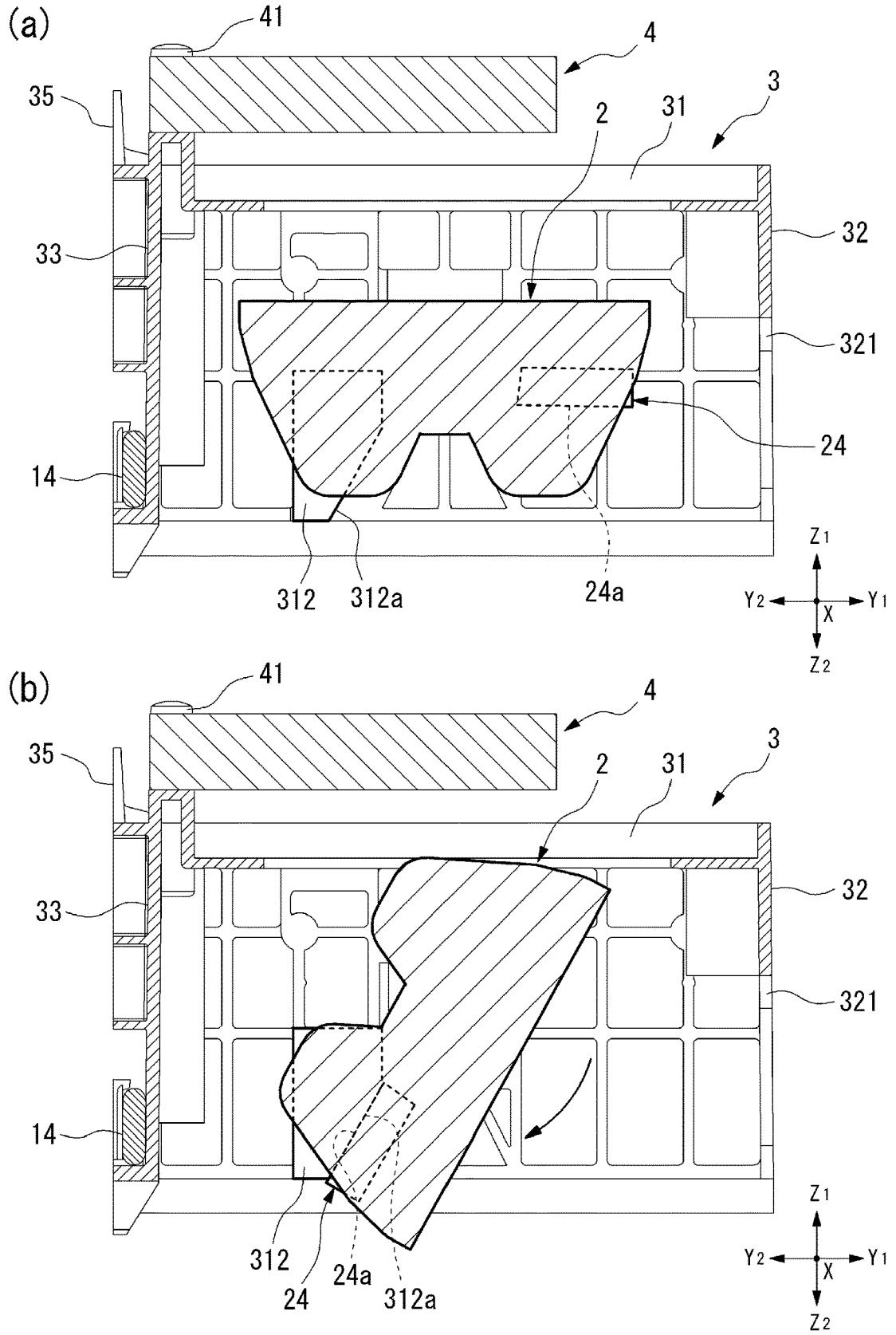
FIG. 5 is cross-sectional rear views for explaining an ice removing operation of the ice making device.

FIG. 5 is cross-sectional rear views for explaining the ice removing operation of the ice making device U. (a) of FIG. 5 is a diagram illustrating a state in which the ice making tray 2 is arranged horizontally, and (b) of FIG. 5 is a diagram illustrating an arrangement of the ice making tray 2 during the ice removing operation.

At the front plate unit 31 of the frame 3, a solid rib 312 is formed integrally on a back side of the wall unit hollowed in a lattice shape. The rib 312 includes the block unit 312*a* being a surface configured to contact a bottom surface 24*a* of the convex unit 24 of the ice making tray 2 in rotation to partially disturb the rotation of the ice making tray 2. The ice removing mechanism according to the present embodiment includes the driving unit 1 configured to rotate the ice making tray 2, the convex unit 24, and the block unit 312*a*.

The ice removing control unit 152 of the control device 15 activates the driving unit 1 to start the ice removing operation if detecting that the temperature of the ice making tray 2 reaches −10° C. and ice is made. The ice removing control unit 152 lowers the ice detection arm 12 into the ice storage container before rotating the ice making tray 2 to inspect the amount of ice, confirms that there is still a space in the ice storage container, and then rotates the ice making tray 2 clockwise as illustrated in FIG. 5.

When the ice making tray 2 rotates by a predetermined degree, the bottom surface 24*a* of the convex unit 24 comes into contact with the block unit 312*a*. The ice removing control unit 152 further rotates the ice making tray 2 and deforms the ice making tray 2 to be twisted. As a result, ice in the ice making tray 2 is pushed out of each of the cells 21 and falls into the ice storage container placed under the ice making device U.

After ice is taken out from the ice making tray 2, the ice removing control unit 152 rotates the ice making tray 2 counterclockwise as illustrated in FIG. 5 to return the ice making tray 2 to a horizontal position. If detecting that a series of ice removing operations is completed, the control device 15 opens the water supply valve V by the water supply control unit 153 to fill the ice making tray 2 with subsequent water.

(Fan Motor and Fixing Structure Thereof)

The fan motor 4 according to the present embodiment is a general air blower in which blades (fans) are integrated with a motor. The fixing structure of the fan motor 4 will be described below with reference to FIGS. 1, 2, and 4.

The fan motor 4 according to the present embodiment includes a case body having a substantially square outer peripheral shape in a plan view, and only an end included in one side of the fan motor 4 is fixed to the left plate unit 33 with the screw 41. Although not illustrated, the fan motor 4 includes a wind path penetrating in a thickness direction (up-down direction), and a fan built in the fan motor 4 sucks air from an opening on the upper surface of the fan motor 4 and exhausts air from an opening on a lower surface thereof. That is, the fan motor 4 blows air downward.

The ice making tray 2 according to the present embodiment is a water storage container made of resin. Unlike an ice making tray made of metal, the ice making tray 2 made of resin acts like a heat insulating material. Therefore, if the wind from the fan motor 4 blows from under the ice making tray 2 toward the ice making tray 2, inefficiency in the fan motor 4 occurs. In the present embodiment, the wind blows from above the ice making tray 2 toward the ice making tray 2, that is, the wind from the fan motor 4 directly blows to water in the ice making tray 2, and thus, solidification heat can be released smoothly from the water in the ice making tray 2.

The fan motor 4 according to the present embodiment is fixed only to the left plate unit 33. In the following description, a "fixing unit" refers to a part at which the fan motor 4 and the pedestal unit 331 are relatively immovably joined to each other, such as screw hole portions of the fan motor 4 and the pedestal unit 331 that are fixed with the screw 41. Furthermore, a "fixing surface" refers to a common surface on which a plurality of fixing units on a side of the frame 3 are arranged, such as the upper surface of the pedestal unit 331.

When the ice removing operation starts, and the convex unit 24 of the ice making tray 2 is pressed against the block unit 312*a* of the front plate unit 31, the frame 3 being a resin frame body deforms its outer shape to be twisted. At this time, if the fan motor 4 is fixed across a plurality of frame parts included in the frame 3, the displacement directions and displacement amount of these frame parts differ from each other, and thus, the fixing surface of the fan motor 4 is distorted. In the ice making device U according to the present embodiment, the fixing unit of the fan motor 4 is provided only on one frame part (left plate unit 33) included in the frame 3, and thus, distortion on the fixing surface of the fan motor 4 is suppressed to a small degree, and loosening and damage of the fixing unit of the fan motor 4 are suppressed.

Furthermore, in the ice making device U according to the present embodiment, the fan motor 4 is fixed to the pedestal unit 331 having a thickness in the up-down direction greater than thickness of a different portion, of the upper surface 33*a* of the left plate unit 33. When the fixing surface of the fan motor 4 is formed thick and rigidity thereof is enhanced, even if the left plate unit 33 deforms, the distortion of the fixing surface of the fan motor 4 is suppressed to a small degree.

Furthermore, as described above, the two mounting units 35 configured to fix the ice making device U to the wall surface W of the freezing room with the screws 352 are provided on the upper surface 33*a* of the left plate unit 33. The mounting units 35 on the left plate unit 33 limit the deformation of the left plate unit 33 if being immovably fixed to the wall surface W in the freezing room. The pedestal unit 331 is provided between these two mounting units 35. In a portion between the two mounting units 35, the propagation of distortion is mutually interrupted by these mounting units 35, and thus, the amount of deformation is particularly small. Thus, in the ice making device U according to the present embodiment, the fan motor 4 is fixed only to the thick pedestal unit 331 provided between the two mounting units 35, and thus, the influence on the fan motor 4 caused by the distortion of the frame 3 during removing ice is suppressed to a small degree.

Furthermore, as illustrated in FIG. 4, a rotation center C of the fan motor 4 is located at a position closer to a side of the left plate unit 33 than a center position A between the right plate unit 32 and the left plate unit 33 in a plan view of the frame 3. When the mounting units 35 of the left plate unit 33 are fixed to the wall surface W of the freezing room with the screws 352, the wind path on the side of the left plate unit 33 is limited by the wall surface W of the freezing room, and the air pressure is higher than that at a side of the right plate unit 32 or at a side of the front plate unit 31 at which there is no such limitation. That is, the wind from the fan motor 4 hardly flows to the side of the left plate unit 33. Therefore, when the fan motor 4 is placed beforehand at a position closer to the left plate unit 33 and the wind path is set to flow the wind from the fan motor 4 from the side of the left plate unit 33 to a different side, the air stagnation at the side of the left plate unit 33 can be prevented and the solidification heat can be released smoothly.

It is noted that in the present embodiment, the wind from the fan motor 4 also hardly flows to a side of the rear plate unit 34 where the driving unit 1 is placed. Therefore, the rotation center C of the fan motor 4 is provided at a rear side relative to a center position in an axial direction of the ice making tray 2. The notch 321 is provided on the right plate unit 32 according to the present embodiment, and the front plate unit 31 is hollowed in a lattice shape. Thus, the wind from the fan motor 4 is guided to the side of the right plate unit 32 and the side of the front plate unit 31 to prevent an airflow from being stagnated on the side of the left plate unit 33 and on the side of the rear plate unit 34.

(Drive Control of Fan Motor)

Figure 6:
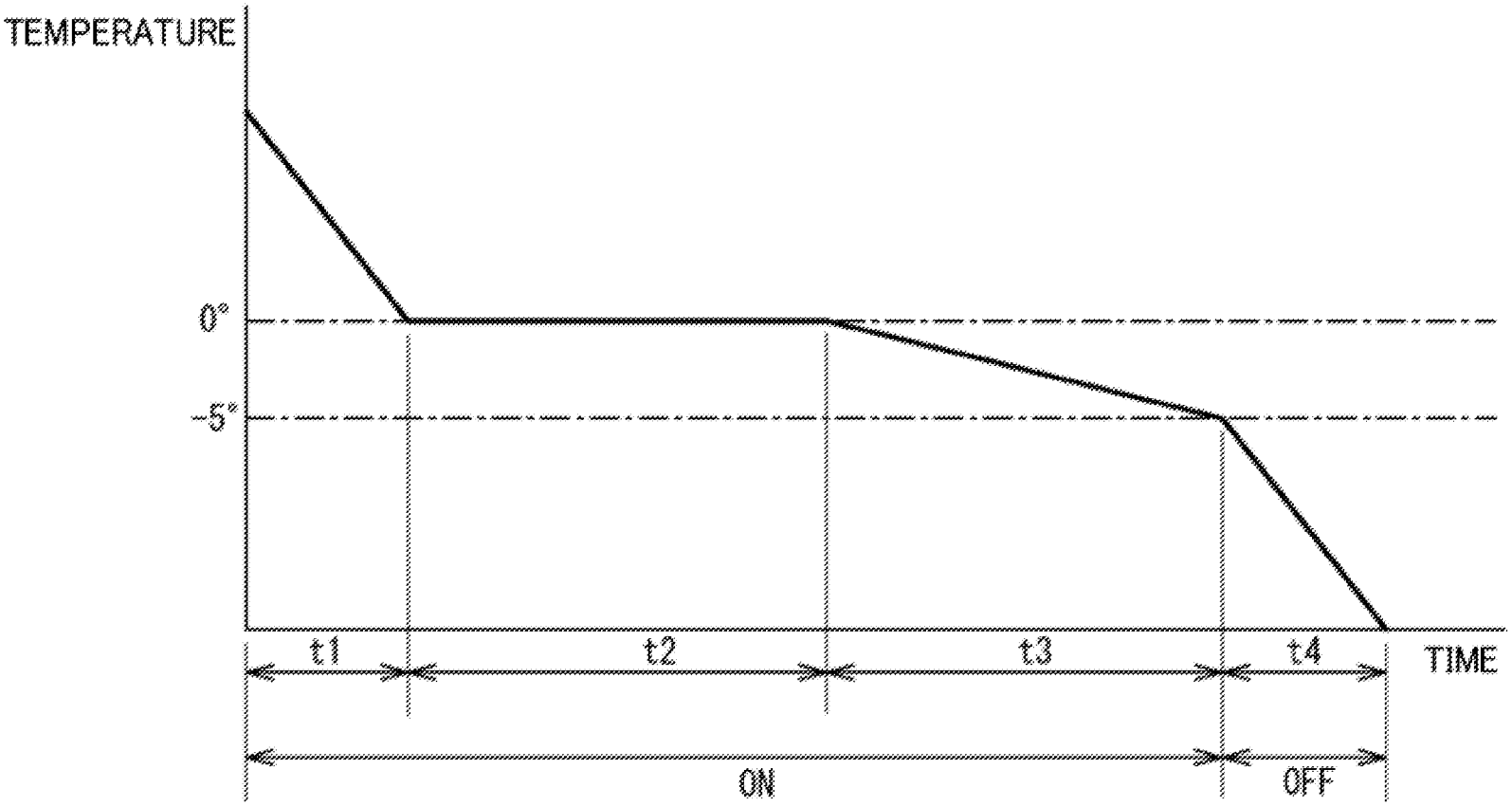
FIG. 6 is a graph showing a method of controlling a fan motor by the control device.

FIG. 6 is a graph showing a method of controlling the fan motor 4 by the control device 15.

The fan control unit 151 of the control device 15 drives the fan motor 4 after water is supplied to the ice making tray 2 until the temperature of the ice making tray 2 reaches −5° C. Then, the ice removing control unit 152 of the control device 15 starts the ice removing operation if the temperature of the ice making tray 2 reaches −10° C.

The temperature change of the water supplied to the ice making tray 2 is divided into a period (t1) during which the water temperature reaches 0° C. after water is supplied, a period (t2) during which the water temperature is maintained near 0° C. and solidification heat is generated, and periods (t3, t4) during which the water temperature transfers gradually from 0° C. to a minus temperature.

The heat transfer of the water supplied to the ice making tray 2 occurs frequently after water is supplied until reaching 0° C. and around 0° C. at which the water changes its state to ice (t1-t3). That is, when the fan motor 4 is driven only during a period where the air blown by the fan motor 4 is effective, the power of the ice making device U can be saved while the ice making capability of the ice making device U is maintained. The fan control unit 151 according to the present embodiment starts the drive of the fan motor 4 after water is supplied to the ice making tray 2 and stops the drive when the temperature of the ice making tray 2 reaches −5° C. Then, the ice removing control unit 152 starts the ice removing operation when the temperature of the ice making tray 2 reaches −10° C. It is noted that a temperature setting in the present embodiment is only an example. The temperature at which the fan motor 4 is stopped may be 0° C. or below, and the temperature for starting the ice removing operation may be the same as the temperature for stopping the fan motor 4. Furthermore, the fan motor 4 needs not be driven immediately after water is supplied to the ice making tray 2, and the fan motor 4 may be driven after a predetermined time has elapsed after water is supplied to the ice making tray 2.

Although the embodiments of the present invention have been described above, the present invention is not limited to the above-described embodiments, and various modifications may be applied without departing from the spirit of the present invention.

What is claimed is:

1. An ice making device comprising:

an ice making tray;

a drive unit configured to turn over the ice making tray;

a frame including a frame body, the frame configured to support the ice making tray; and a fan motor configured to send wind to the ice making tray, wherein the frame includes a block unit configured to contact a part of the ice making tray turning over to partially disturb the turning over of the ice making tray, and the fan motor is fixed only to a first frame part as one of a plurality of frame parts constituting sides surrounding a periphery of the ice making tray in a plan view of the frame, wherein the frame includes, of the plurality of frame parts, a second frame part as a frame part facing the first frame part across the ice making tray, and a rotation center of the fan motor is located at a position closer to a side of the first frame part than a center position between the first frame part and the second frame part in the plan view of the frame.

2. The ice making device according to claim 1, wherein the frame includes a mounting unit configured to fix the ice making device in a freezing room, and the mounting unit is provided on the first frame part.

3. The ice making device according to claim 2, wherein the first frame part includes a plurality of the mounting units, and the fan motor is fixed between one of the mounting units and a different one of the mounting units included in the first frame part.

4. The ice making device according to claim 2, wherein an outer peripheral shape of the frame includes substantially rectangle in the plan view of the frame, and the first frame part constitutes one of long sides in the plan view of the frame.

5. The ice making device according to claim 1, wherein the second frame part includes a plate-shaped frame part, and the second frame part is provided with a notch through which wind from the fan motor blows in a horizontal direction.

6. The ice making device according to claim 1, wherein the first frame part includes a pedestal unit as a portion having a thickness in an up-down direction greater than a thickness of a different portion, and the fan motor is fixed to the pedestal unit.

7. The ice making device according to claim 1, wherein the ice making tray is made of resin, and the fan motor sends wind to the ice making tray from above the ice making tray.

8. An ice making device according to claim 1 comprising:

an ice making tray;

a drive unit configured to turn over the ice making tray;

a frame including a frame body, the frame configured to support the ice making tray; and a fan motor configured to send wind to the ice making tray, wherein the frame includes a block unit configured to contact a part of the ice making tray turning over to partially disturb the turning over of the ice making tray, and the fan motor is fixed only to a first frame part as one of a plurality of frame parts constituting sides surrounding a periphery of the ice making tray in a plan view of the frame, wherein an outer peripheral shape of the fan motor is substantially square in the plan view of the fan motor, and the fan motor is fixed to the first frame part only at an end included in one side of the fan motor in the plan view of the fan motor.

* * * * *